United States Patent [19]

Meyers

[11] 4,263,498

[45] Apr. 21, 1981

[54] EXPANSION CHAMBER ARRANGEMENT FOR WATER HEATING AND DISPENSING DEVICE

[75] Inventor: Theodore F. Meyers, Troy, Ohio

[73] Assignee: Hobart Corporation, Troy, Ohio

[21] Appl. No.: 15,183

[22] Filed: Feb. 26, 1979

[51] Int. Cl.[3] ..... F24H 1/20; B67D 5/62

[52] U.S. Cl. ..... 219/312; 137/205.5; 137/341; 137/593; 219/306; 219/314; 222/108; 222/146 HE; 222/319; 237/66

[58] Field of Search ..... 219/312, 310, 314, 323, 219/324, 306; 126/362; 222/146 R, 146 H, 146 HE, 571, 319, 108; 137/206, 205.5, 207, 207.5, 282, 593, 341; 237/66

[56] References Cited

U.S. PATENT DOCUMENTS

| | | | |
|---|---|---|---|
| 2,110,251 | 3/1938 | Wolcott | 219/328 |
| 2,598,968 | 6/1952 | Boosey | 137/282 |
| 2,819,376 | 1/1958 | Karlen | 219/327 X |
| 2,869,760 | 1/1959 | Karlen et al. | 222/146 HE |
| 2,870,318 | 1/1959 | Karlen | 219/314 X |
| 2,894,109 | 7/1959 | Kendon | 219/312 X |
| 3,080,119 | 3/1963 | Shutkufski | 237/66 X |
| 3,202,321 | 8/1965 | Homeyer | 222/108 |
| 3,381,110 | 4/1968 | Fischer | 219/312 X |
| 3,581,057 | 5/1971 | Meyers | 219/314 X |
| 3,891,124 | 6/1975 | Dreibelbis | 219/312 X |
| 3,905,518 | 9/1975 | Dreibelbis et al. | 312/319 |

FOREIGN PATENT DOCUMENTS

| | | | |
|---|---|---|---|
| 397259 | 8/1933 | United Kingdom | 219/314 |
| 423820 | 2/1935 | United Kingdom | 219/314 |
| 450991 | 7/1936 | United Kingdom | 219/310 |
| 662739 | 9/1948 | United Kingdom | 219/314 |

*Primary Examiner*—A. Bartis

*Attorney, Agent, or Firm*—Biebel, French & Nauman

[57] ABSTRACT

A water heating and dispensing device includes a tank which forms the main hot water container, a heating device in the tank which is thermostatically controlled in order to maintain the temperature of the water at the desired level, inlet and outlet conduits associated with the tank and a valve associated with the inlet conduit for controlling water flow into the tank and dispensing of water from the outlet conduit. A separate reservoir is connected to the inlet conduit between the valve and the tank through a venturi nozzle which permits water to flow into and out of the reservoir. The reservoir has collapsible wall portions which collapse to provide for a decrease in volume in the reservoir as water is drawn from it through the venturi nozzle during dispensing of water, and which is expandable to an expanded maximum completely filled condition after dispensing has ceased, as a result of water flowing back from the main hot water container through the venturi nozzle. The maximum filled position has a sufficient volume to reduce the water level in the tank and outlet conduit sufficiently to allow for expansion of water in the tank due to heating, without dispensing water from the outlet conduit due to expansion. The reservoir comprises a cylindrical collapsible tube concentric with the inlet conduit and provided at one end with a rigid closure member in which is formed the venturi nozzle.

3 Claims, 5 Drawing Figures

EXPANSION CHAMBER ARRANGEMENT FOR WATER HEATING AND DISPENSING DEVICE

BACKGROUND OF THE INVENTION

1. Field of the Invention

The present invention relates to hot water heating devices, and more particularly, to open-to-atmosphere hot water heating and dispensing devices utilized, for example, adjacent the tap water dispenser in the domestic kitchen, for dispensing hot water at close to the boiling point.

2. Prior Art

Hot water heating and dispensing devices of the type to which the present invention relates are commonly used for providing hot water at close to the boiling point for preparation of hot beverages such as instant coffee and the like, and are generally well known in the prior art. For example, such devices are disclosed in U.S. Pat. No. 3,381,110 to Fisher and Karlen et al U.S. Pat. No. 2,869,760; and similarly in British Pat. No. 662,739. All of these devices include a small hot water tank which can be easily disposed underneath a counter top adjacent a sink and are provided with outlet conduits which can extend above the counter top over the sink for dispensing hot water at a much higher temperature than is available from the conventional tap which receives its hot water from the much larger central hot water heater disposed at a remote location from the sink.

Many such devices, including those mentioned above, have delt with the problem in such hot water dispensers of having an over flow of hot water out of the discharge or outlet conduit due to expansion of the water in the tank when it is heated. Such a discharge can be both annoying and cause minor damage to other equipment. For example, the dripping of hot water from the outlet conduit can cause discolorations in the sink in the form of sedimentary deposits left by the water.

It was recognized early in attempts to solve this problem that it is advantageous to provide an additional reservoir for allowing liquid displaced due to expansion to be accumulated in the reservoir rather than being forced out of the discharge conduit. It was also recognized that it was advantageous to place such a reservoir on the inlet side of the main tank. This is true for two reasons. First, it is preferable that the water which was displaced due to expansion is cold water and not water heated by the tank since this reduces the effect of sedimentation deposits in the opening to the reservoir from the main tank since it is well known that such sedimentation is enhanced by the high temperature. Second, it reduces energy losses which occur on such devices where hot water is expelled from the main tank into the reservoir and is thus permitted to cool and expel its heat to the atmosphere.

There are further variations in the manner in which such devices function. For example, the device disclosed in the above referred to U.S. Pat. No. 3,381,110 places an expansion chamber at the upper portion of the main heating tank at the level where the discharge conduit opens into the tank. By placing the reservoir at this position and connecting the reservoir with the inlet side of the water source to the tank, the cooler water in the bottom of the tank will be expelled through the inlet conduit to the reservoir as the water in the tank expands due to heating. As the water rises in the outlet conduit the additional volume of the reservoir will in essence act as an increased volume in the outlet conduit but will have cooler water in the reservoir rather than the hot water which is displaced from the top of the tank into the outlet conduit. Thus, in other words, the reservoir in such a device acts as an expansion reservoir which is only filled upon displacement of liquid due to expansion upon heating.

A further variation is disclosed in the above referred to British Pat. No. 662,739 in which an expansion tank is disposed in the inlet conduit to the main hot water heating tank, but is designed and connected to the inlet conduit to the hot water in the tank such that upon closing of the valve from the water supply source water will immediately return to the reservior from the main hot water heating tank. This manner of construction thus provides an open free volume at the top of the main tank which is sufficient to permit expansion of water in the tank due to heating without expelling water from the outlet conduit from which it is dispensed.

A further problem which has been recognized with such prior art devices is that if the water in such reservoirs is permitted to be exposed to air and is not utilized in a short period of time it will become stagnant, causing an undesirable taste in the water due to the inter action of the constituents in the water and the air with which it is in contact. It has been suggested that this problem can be overcome in one way, for example, as disclosed in the above referred to U.S. Pat. No. 3,381,110. This is by providing a flexible diaphragm which forms the top surface of the reservoir so that as water is displaced into the reservoir it will contact the diaphragm and thus eliminate the air space that will otherwise exist if a completely rigid reservoir were utilized.

SUMMARY OF THE INVENTION

The present invention overcomes the disadvantages and difficulties associated with the above referred to prior art devices and provides a hot water heating and dispensing device which is both economical in construction and efficient in operation.

These advantages are accomplished by providing a hot water heating and dispensing device having a tank which forms the main hot water container, a heating device in the tank which is thermostatically controlled in order to maintain the temperature of the water at the desired level for dispensing, inlet and outlet conduits associated with the tank and a valve for controlling water flow into the tank and dispensing of water from the outlet conduit from the tank, a reservoir connected to the inlet conduit with an opening for ingress and egress of water into and out of the reservoir, the reservoir having collapsible wall portions which are movable between a minimum volume and a maximum completely filled volume and which provides for decrease in volume to the minimum volume upon egress of water from the reservoir and which is expandable upon ingress of water to the reservoir to the maximum completely filled position and which has a sufficient volume to reduce the water level in the tank and in the outlet conduit sufficiently to allow for expansion of water in the tank due to heating without dispensing water from the outlet conduit due to expansion.

The reservoir is positioned relative to the main hot water heating tank so that the upper region of the cavity which forms the reservoir is below the minimum water level in the hot water tank so that the reservoir will be completely filled with water as the head pressure in the tank and outlet conduit causes the water to flow backwardly into the reservoir when the supply line is shut off. This construction eliminates the possibility of air being captive above the liquid in the reservoir which would otherwise cause stagnation of the water when the hot water heating and dispensing device is not in use.

One preferred construction of a reservoir is in the form of a collapsible cylindrical member constructed, for example, of silicone rubber and is in the form of a tube concentrically disposed about the inlet conduit which supplies water to the bottom of the hot water tank. As water passes through the inlet conduit from the source of supply it withdraws water from the reservoir causing it to collapse about the tube which passes through the reservoir. As the source of supply is shut off, the pressure head in the tank and outlet conduit causes the water to immediately pass back into the reservoir from the inlet conduit filling the reservoir completely to its maximum expandable position.

The reservoir is so connected to the inlet conduit that as water passes through the inlet conduit into the hot water heating tank it will withdraw the water from the reservoir so that the walls will collapse to their minimum volume condition. This can be accomplished, for example, by the use of a venturi nozzle at the opening from the reservoir into the inlet conduit so that the low pressure on the downstream side of the nozzle will cause the water in the reservoir to be withdrawn and to be passed through the inlet conduit into the hot water heating tank. On closing off of the water supply source, the water, as a result of a head pressure in the tank and the discharge conduit, will cause water to flow back into the reservoir expanding the collapsible wall portions and completely filling the reservoir and thus reducing the level of water in the heating tank by a sufficient volume to permit expansion thereof as it is heated.

An alternative construction of the reservoir is in the use of a bellows-type member also disposed concentrically with the inlet conduit from the supply source, but into which the inlet conduit directly empties through a flapper valve. As water passes through the bellows-type member and through the flapper valve the pressure on the upstream side of the valve acts on the upper surface of the bellows and causes the bellows to collapse thus reducing it to its minimum volume and expelling the water from the bellows into the inlet conduit and thus into the bottom of the hot water tank. When the water from the supply source is shut off the pressure head in the hot water tank and outlet conduit immediately causes the bellows to expand to its maximum filled volume thus providing a free volume in the top of the hot water tank for expansion of water due to heating without dispensing water through the outlet conduit.

DETAILED DESCRIPTION OF THE PREFERRED EMBODIMENTS

Figure 1:
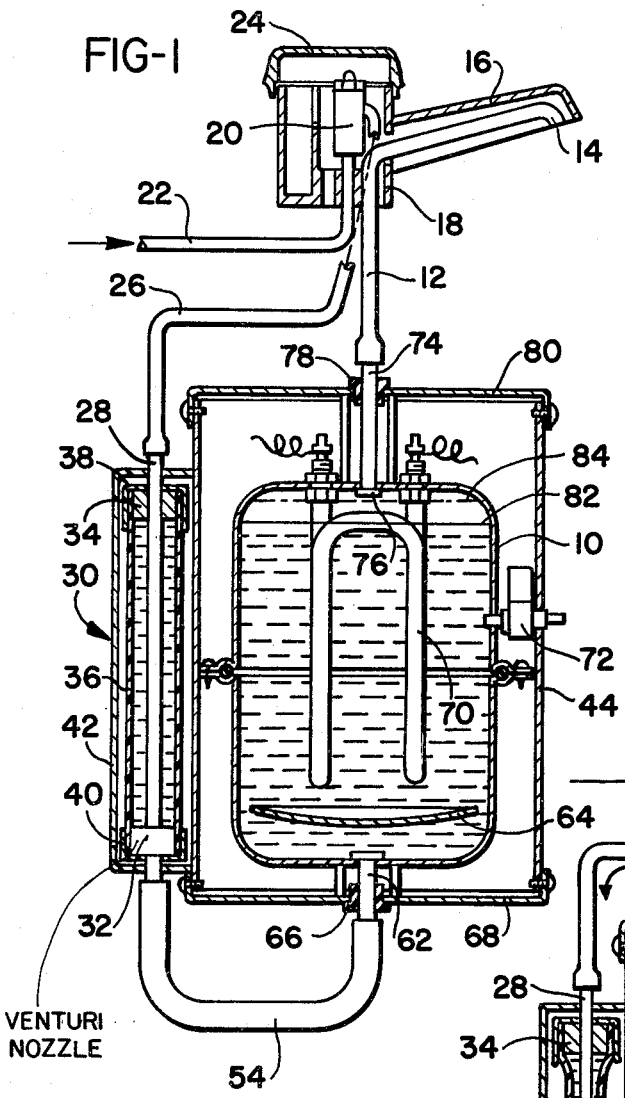
FIG. 1 is a cross sectional view through a vertical plane passing through the center of the device of a first preferred embodiment of the present invention, including the dispensing valve, the hot water tank and the reservoir means, with the valve in the closed position.
Figure 2:
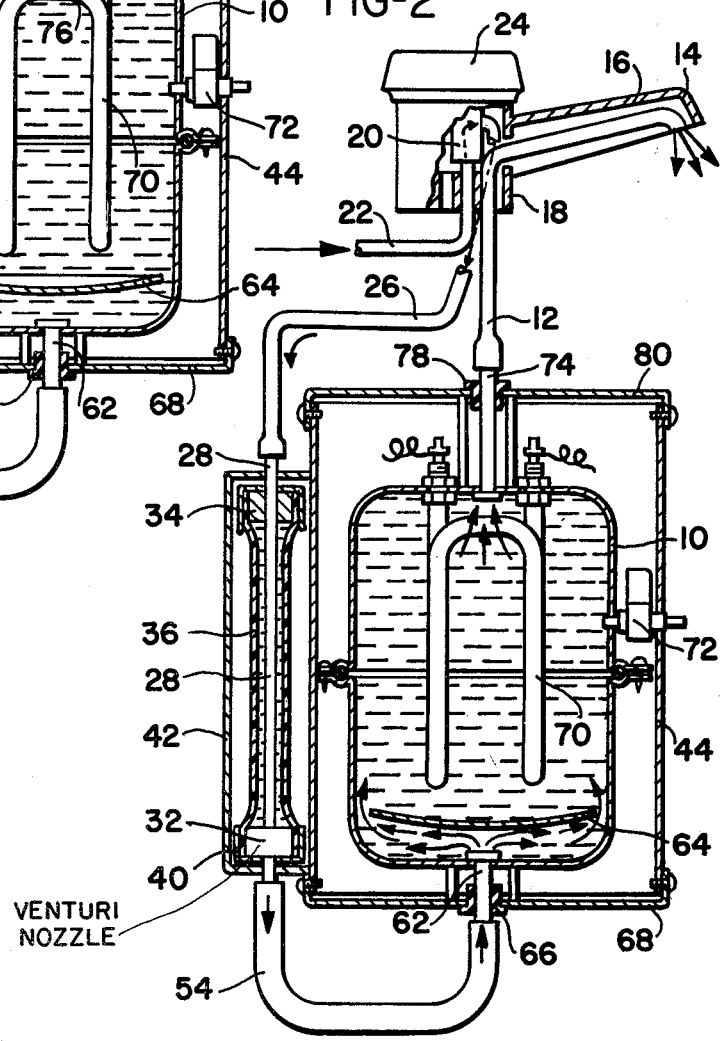
FIG. 2 is a view as in FIG. 1, but with the valve in the open position and illustrating the flow of water through the device and the construction of the reservoir means.

Referring to the illustrations of FIGS. 1 and 2, the main hot water heating tank 10 has connected thereto an outlet conduit 12 which opens into the top portion of tank 10 and through which water heated in tank 10 is expelled and dispensed through the opening 14 which is positioned in a spigot 16 that would be disposed above a counter top and extending over a sink (not shown).

In the preferred embodiment, the spigot 16 is mounted as an extension from a cylindrical base 18 which houses the control valve 20 that controls water supply to the hot water tank 10 from the pressurized supply source 22. This arrangement of spigot 16, base 18 and control valve 20 provides an acceptable arrangement where the control valve 20 can be disposed immediately adjacent the spigot and can be controlled by rotation of the cylindrical control knob 24 positioned on the top of base 18. The base 18 can be fastened to the counter top adjacent the sink so that both the control valve 20 and the spigot 16 are in the same location. If desired, however, the control valve 20 can be positioned remotely from the spigot 16 since it is merely a question of extending the line from the supply source 22 to the location of the valve 20 and the outlet line 26 from the valve 20 to the hot water heater 10.

That portion of the supply line referred to as outlet conduit 26 is actually the inlet conduit to the hot water tank 10 and is preferably formed of a flexible material such as copper tubing or a plastic tubing so that it can be deformed for proper location of the valve 20 relative to the tank 10 for a given installation under a counter top. Valve 20 is of conventional construction and permits the volume of water passing from the supply source 22 to conduit 26 to be increased or decreased upon rotation of the knob 24.

Conduit 26 is connected to a straight relatively rigid length of tubing 28 which passes through a reservoir 30 that provides the expansion volume for the hot water tank 10. The tube 28 is fastened at its lower end to the bottom end cap 32 of the reservoir 30, the construction of which is described in more detail below. The upper portion of tube 28 passes through an upper end cap 34 of reservoir 30 which sealingly engages the outer periphery of the tube to make a water tight connection.

The main body portion 36 of the reservoir 30 is in the form of a cylindrical collapsible tube constructed of flexible material such as a silicone rubber and has its end portions sealingly fitted over each of the end caps 32 and 34 to provide a water tight compartment. A further upper outer end cap 38 formed of a more rigid material snuggly fits over the outer surfaces of the main body portion 36 and assists in holding it in sealing engagement with the upper end cap 34. Likewise, a lower outer end cap 40 is fitted over the outer surface of the lower end portion of the main body portion 36 and assists in holding it in sealing engagement with bottom end cap 32 so that the reservoir 30 becomes water tight to prevent leakage therefrom. An additional cylindrical metal housing 42 is provided around the outer circumference of the reservoir 30 in spaced relation from the walls of the main body portion 36 and is secured such as by welding or bolting to a larger cylindrical housing 44 surrounding the main hot water heating tank 10. Although the housing 42 is not essential since the reservoir 30 can either be freely suspended from the conduit 26 or otherwise supported on the surface of housing 44 such as by metal clips or the like, it does have the advantage of providing a protection for the collapsible main body portion 36 which may be susceptible to rupturing if accidentally impacted by some object placed under the counter top beneath the sink since this is a common storage area for household cleaning articles and the like.

Figure 3:
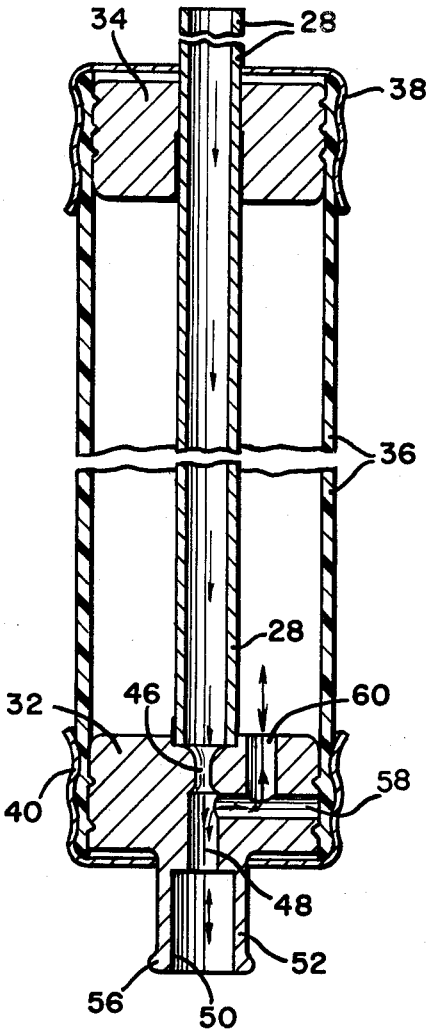
FIG. 3 is an enlarged cross sectional view of the reservoir means of the first preferred embodiment.

Referring to the construction of the bottom end cap 32, as is best seen in FIG. 3, the main portion thereof is of cylindrical form with the tubing 28 being secured in a recessed cylindrical opening concentric therewith and which is aligned with a venturi nozzle 46 formed in bottom end cap 32. At the output side of nozzle 46 is a further cylindrical hole 48 formed in the end cap 32 which expands into a larger opening 50 formed in a cylindrical extension 52 of bottom end cap 32 that is provided with an external diameter for matingly engaging a flexible input supply tube 54 as seen in FIG. 1, and which has a cylindrical rib 56 around its outermost end portion to assist in holding the tube 54 onto the extension 52. A further cylindrical passage 58 extends through the bottom end cap 32 into the central opening 48 and is intercepted by a cylindrical opening 60 in communication with the inside of the main body portion 36 which forms the reservoir 30.

With this construction of the bottom end cap 32, as water passes through the tube 28 from the valve 20 from the supply source 22 it will pass through the venturi nozzle 46 and cause a reduced pressure area immediately thereafter in the opening 48 which in turn will result in withdrawal of water from the reservoir 30. Water will continue to be withdrawn in this manner as long as the valve 20 is in the open position and will cause the collapsible main body portion 36 to be drawn inwardly towards the surface of tube 28 until the minimum volume is reached in which the collapsible tube has deformed to its maximum extent as is illustrated in FIG. 2.

The supply conduit 54 is fitted at the opposite end portion from that fitted to end cap 32, to an input tube 62 which opens in the bottom portion of hot water tank 10. Disposed immediately above the opening in tube 62 is a cold water deflection plate 64 which disperses the cold water around the edges thereof, as illustrated by the arrows in FIG. 2. Such a plate can, for example, be constructed of a rectangular piece of metal which is secured at its corners, such as by welding to the inner surface of the tank 10, leaving the openings formed between the straight sides of the deflector plate 64 and the adjacent cylindrical inner surface of the tank 10 to form passages through which the cold water will be dispersed around the outer surfaces of the tank 10. This prevents the cold water from being ejected directly upward into the hot water which is being expelled through the outlet tube 12 which would reduce the temperature of water dispensed from the device. The inlet tube 62 is supported in a rubber grommet 66 in a lower closure plate 68 bolted or otherwise secured to the lower end portion of housing 44. The upper end portion of the tube 62 is sealingly mounted to the inside of tank 10 in order to prevent leakage therefrom.

A heating coil 70 is disposed in the central region of the hot water tank 10 and is connected to an electrical supply source (not shown) which in turn is controlled by a thermostatic control means 72 extending into the side of tank 10 to sense the temperature of the water therein and to activate or deactivate the heating coil 70 upon demand as is established by a predetermined setting of the thermostatic control device 72.

The outlet conduit 12 is sealingly secured to a tube 74 opening into the top of tank 10 whose end portion 76 is sealingly engaged with the inner surface of the tank 10 to prevent leakage of water therefrom. A rubber grommet 78 supports tube 74 in an upper closure plate 80 bolted or otherwise secured to the upper end of cylindrical housing 44. Although not shown, the space surrounding the heating tank 10 within the housing 44 and end caps 68 and 80 is preferably filled with insulation material in order to reduce heat loss and thus conserve energy use of the device.

Referring to the manner in which the device of the present invention operates, when the device is in the inoperative position, as illustrated in FIG. 1 with the valve 20 closed to prevent water from entering from the supply source 22, the water level in the hot water tank will initially be at the solid line position 82 until heated where it will expand to the dotted line position 84. In this inoperative state, water will completely fill the reservoir 30 and the main body portion 36 will be expanded to its maximum filled position. Upon operation of the valve 20 to permit water to pass therethrough from the supply source 22, water will pass through the conduit 26, tube 28 and through the end cap 32. As it passes through the end cap 32 it will pass through the nozzle 46 producing a low pressure region on the downstream side thereof which will in turn withdraw water from the reservoir 30 through openings 58 and 60 and into the opening 48 where it will pass through supply line 54 and then into the bottom of the hot water tank 10. As the hot water tank is filled it will eventually expel hot water through the outlet conduit 12, as best seen in FIG. 2, from which it will then be dispensed from the spigot 16 for use.

As the valve 20 is then closed after dispensing water from spigot 16 and no more water is permitted to enter from the supply source 22, the pressure head created by the water standing in the outlet conduit 12 and tank 10 will cause the water to flow backwardly through supply line 54 into the reservoir 30 through openings 58 and 60 to expand the collapsible walls of the main body portion 36 to their maximum filled position. This in turn will cause the water to flow out of the outlet conduit 12 back into the tank 10 and reduce the level of water in the tank 10 to approximately the level 82 as shown in FIG. 1.

The appropriate volume available in reservoir 30 is dependent upon the size of a given hot water tank and can easily be determined by establishing the expansion in volume due to the increase temperature upon heating of the water in the tank 10 so that the reservoir can be properly sized to provide the necessary amount of expansion in order to prevent water from expanding up into the outlet conduit 12 and being dispensed from the spigot 16.

From the above described operation it should be evident that the position of the top of the reservoir 30 should be even with or below the level of fall back of water in the tank 10, as indicated by line 82 in the FIG. 1, in order that the reservoir 30 be completely filled when the valve 20 is closed. This is important in order to maximize the volume of water which can be withdrawn from the tank due to the head pressure. Although when the device is initially installed the reservoir 30 is totally filled with air, most of it will be withdrawn upon first use of the device and any remaining amounts may be absorbed by the water if the reservoir 30 is properly positioned below the lowest level of the surface of the water in tank 10.

Figure 4:
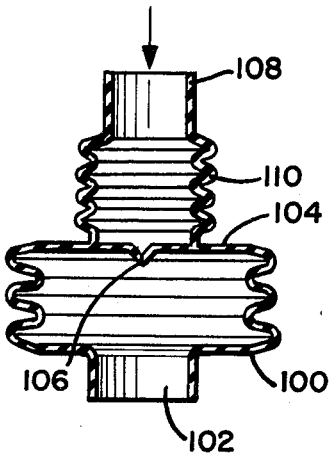
FIGS. 4 and 5 are cross sectional views through an alternative embodiment of the reservoir means of the present invention.
Figure 5:
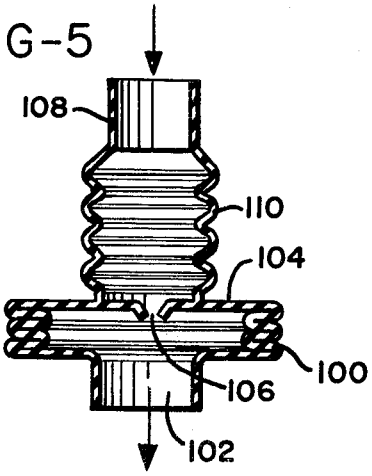

The above disclosed basic function of the present invention can take many forms. For example, a second preferred embodiment of the reservoir means for the present invention is illustrated in FIGS. 4 and 5. This embodiment can be positioned in essentially the same location as the above described embodiment and its inlet and outlet openings can be connected to the inlet line essentially as shown with the previous embodiment. The construction and operation of this embodiment are somewhat different, however, in that this device is constructed of a bellows-type member 100, also preferably made of a silicone rubber or other collapsible flexible material. It is of generally cylindrical construction with the bellows construction for side walls and has an outlet opening 102 which can be directly connected in sealing engagement with the supply line 54 that connects to the bottom of tank 10.

On the upper closure cylindrical surface 104 of the bellows-like member 100 is formed a flapper valve 106. This can, for example, be constructed by simply cutting two perpendicular slits through the material forming the upper surface 104 which slits are concentrically aligned with the inlet tube 108 and the outlet opening 102. As water passes through the device from the inlet tube 108 to the outlet opening 102 in the direction of the arrow of FIG. 4, the water pressure will cause the flapper valve to open and permit the water to pass therethrough. When the water supply is shut off by closing valve 20 the flapper valve 106 will close due to its own resiliency.

Secured to the upper surface of the top portion 104 is an expandable portion 110 of the inlet tube 108 which functions to permit the bellows to move between its expanded position, as shown in FIG. 4, and its fully contracted position, as shown in FIG. 5. The expandable portion 110 is merely intended to provide a means of expanding between the two positions of the upper surface 104 of the bellows and is not itself to provide any volume expansion utilized for the reservoir. It will be recognized that the difference in volume in the expandable portion 110 between its fully extended and fully compressed positions must be taken into account in determining the size of the bellows since when valve 20 is closed and the pressure head in the tank 10 causes water to expand the bellows 100 the water contained in the expandable portion 110 will pass through flapper valve 106 and add to the amount of water in the bellows.

In operation, this second preferred embodiment will be in the position as illustrated in FIG. 4 when the device is at rest and valve 20 is closed. Upon opening of valve 20 water will pass through the inlet tube 108 and through the flapper valve 106 and pass on through the bellows 100 to the inlet conduit 54 and into the bottom of the hot water tank 10. As this occurs, the surface area on the top of the surface 104 which is impacted by the water flowing through flapper valve 106 will apply pressure causing the bellows 100 to be compressed as illustrated in FIG. 5. This will expel the water from the bellows into the supply conduit 54, compressing the bellows to the position illustrated in FIG. 5. As the valve 20 is closed the head pressure of the water in the outlet conduit 12 and that in the tank 10 will cause the water to flow backwardly into the bellows 100 causing it to expand to its maximum filled position as illustrated in FIG. 4. This maximum filled position, as in the case with the first preferred embodiment, is so designed so that the water in the outlet conduit 12 will fall back into the tank 10 and the level of water in the tank will be reduced to a position which will permit expansion of the water due to heating without causing water to be expelled from the outlet conduit.

It is to be noted that the designs of both the above referred to preferred embodiments of hot water heating and dispensing devices have the advantage that the reservoir means will not be subjected to full line pressure since they are on the downstream side of line 20. This is particularly advantageous since in many areas line pressure is very high and would otherwise require the use of much stronger flexible materials for constructing the reservoirs. In addition, all of the fittings used to connect the various members such as the reservoirs, tanks and tubing together, are likewise never subjected to full line pressure and thus the possibility of leaks developing is also substantially reduced.

Although the foregoing description illustrates the construction and operation of the preferred embodiments, other variations are possible. All such variations as would be obvious to one skilled in this art are intended to be included within the scope of the invention as defined by the following claims.

What is claimed is:

1. A hot water heating and dispensing device, comprising:

a tank forming a hot water container;

heating means in said tank for heating water placed therein;

control means for operating said heating means;

an outlet conduit in the top of said tank providing an exit path for water contained therein for dispensing the same;

an inlet conduit opening into a lower portion of said tank for suppling water thereto;

valve means connected to said inlet conduit for controlling the flow of water into and out of said tank;

reservoir means for receiving water from said tank; and a venturi nozzle connecting said reservoir with said inlet conduit between said valve means and said tank;

said reservoir means being in the form of a collapsible cylindrical tube with at least one rigid closure means in an end thereof, said venturi nozzle being formed in said rigid closure means and providing for ingress and egress of water to and from said tube through said inlet conduit from and to said tank;

said tube being movable between a minimum volume and a maximum substantially filled volume such that upon actuation of said valve means water flowing through said inlet conduit from said valve means and passing through said venturi nozzle will cause water to be withdrawn from said collapsible tube through said inlet conduit and into said tank, said tube being disposed below the top of said tank so that upon closing of said valve means to stop water flow through said inlet conduit, the pressure head of water in said tank and said outlet conduit causes water to flow from said tank through said inlet conduit to said collapsible tube to return the same to said maximum volume, said volume being sufficient to reduce the water level in said tank and outlet conduit so as to allow for expansion of water in said tank due to heating by said heating means without dispensing water from said outlet conduit due to expansion.

2. A hot water heating and dispensing device as defined in claim 1 wherein said cylindrical tube is concentrically disposed with said inlet conduit.

3. A hot water heating and dispensing device as defined in claim 2 wherein a second rigid end closure means is disposed at the end of said cylindrical tube opposite the first said end closure means, each said end closure means mounting said cylindrical tube to said inlet conduit.

* * * * *